United States Patent [19]

Hilton

[11] 4,392,650

[45] Jul. 12, 1983

[54] TENNIS TRAINING AID

[75] Inventor: Carl W. Hilton, Muskegon, Mich.

[73] Assignee: Return on Investment Corporation, Muskegon, Mich.

[21] Appl. No.: 240,168

[22] Filed: Mar. 3, 1981

[51] Int. Cl.[3] ..... A63B 61/00

[52] U.S. Cl. ..... 273/29 A; 273/190 A

[58] Field of Search ..... 273/26 C, 29 A, 183 E, 273/186 C, 187 R, 187 A, 190 R, 190 A, 190 C, 26, 29, 183, 187, 190; 2/8

[56] References Cited

U.S. PATENT DOCUMENTS

| | | | |
|---|---|---|---|
| 2,330,442 | 9/1943 | Nero | 273/190 A |
| 3,025,064 | 3/1962 | Flood | 273/190 A |
| 3,178,187 | 4/1965 | Cardwell | 273/190 A |
| 3,268,228 | 8/1966 | Novack | 273/190 A |
| 3,594,007 | 7/1971 | Kalberer | 273/190 R |

*Primary Examiner*—Richard C. Pinkham
*Assistant Examiner*—T. Brown
*Attorney, Agent, or Firm*—Price, Heneveld, Huizenga & Cooper

[57] ABSTRACT

A training aid primarily adapted to teach a tennis player proper form includes a hood, a headband, and an indicator for indicating when the user's head is tilted downwardly. The hood restricts peripheral vision and requires concentration on the ball. The indicator and hood may move relative to each other so that the indicator moves into the user's field of vision upon tilting of the hood.

14 Claims, 5 Drawing Figures

TENNIS TRAINING AID

BACKGROUND OF THE INVENTION

The present invention relates to sports training devices and more particularly to a unique device for training the user to concentrate and maintain the head, eyes and other body parts in a preferred orientation.

In a wide variety of sports activities, such as golf, baseball and tennis, it is necessary for proper performance and increased proficiency that the player concentrate on the ball and maintain the head, eyes and/or other body parts in a preferred orientation or alignment with respect to the ball and the playing surface. Heretofore, various devices have been proposed for assisting the player in correcting improper form and to increase concentration. For example, devices such as that disclosed in U.S. Pat. No. 3,156,211, entitled INDICATING DEVICE and issued on Nov. 10, 1954, to Mallory, Jr., have been proposed for indicating to the user when the head moves out of a preferred orientation. The device disclosed in this patent is primarily adapted for indicating to a golfer that he has moved this head and taken his eyes off the golf ball.

Other devices have been proposed for limiting the peripheral vision of the user to eliminate distraction and to force the user to concentrate on the activity at hand. An example of one such device may be found in U.S. Pat. No. 3,308,478, entitled HEADPIECE and issued on Mar. 14, 1967, to Tate. The device disclosed in this patent includes a support and a shield. The shield includes a top panel and side panel portions. When positioned on the head of the user, the top panel and side panel portions restrict the peripheral and upward vision of the user.

The prior devices, as represented by the aforementioned patents, have not solved or been addressed to the particular problems experienced by the tennis player. Proper form dictates that the tennis player concentrate on the tennis ball and that the player's head and eyes be maintained in essentially a horizontal plane with respect to the playing surface. In order to properly play low balls, the player should bend his knees while maintaining his eyes in such horizontal plane. It is extremely difficult for the tennis player to know when he is developing bad habits and improperly positioning his head and body with respect to the ball.

A need exists for a training aid device which is primarily adapted for use by a tennis player to force the player to concentrate on the ball and which will indicate to the player when his head is improperly positioned. Preferably, such a device should be of relatively lightweight construction and relatively easily and inexpensively manufactured.

SUMMARY OF THE INVENTION

In accordance with the present invention, the aforementioned needs are substantially provided. Essentially, the subject invention includes means for restricting the peripheral vision of the user to thereby require the user to concentrate on the ball and to eliminate distractions. Indicating means are also included which provide a positive, visual indication to the user when the head and eyes are tilted from an essentially horizontal position relative to the playing surface. The subject invention when worn requires the user to concentrate fully on the ball and teaches proper body and head positioning during play.

In narrower aspects of the invention, the peripheral vision restricting means comprises a hood-like structure including side panels which block the side or peripheral vision of the user. The hood-like member is supported on the head of the user by a headband. The indicating means preferably provide a positive visual indication by blocking or at least partially restricting the field of view of the user when the head is tilted downwardly from a preferred horizontal position.

DETAILED DESCRIPTION OF THE PREFERRED EMBODIMENT

Figure 1:
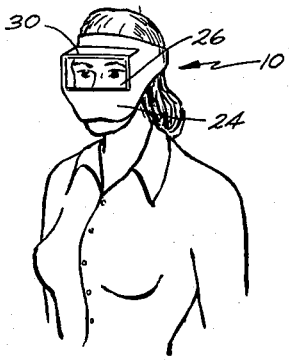
FIG. 1 is a perspective view showing a user wearing the device in accordance with the present invention.
Figure 2:
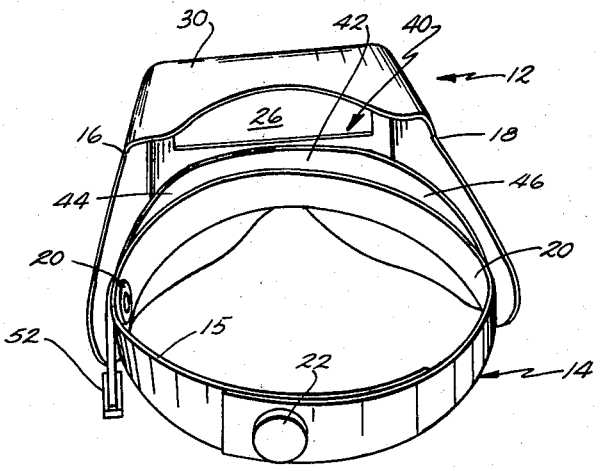
FIG. 2 is a perspective, top, rear elevational view of the device.
Figure 3:
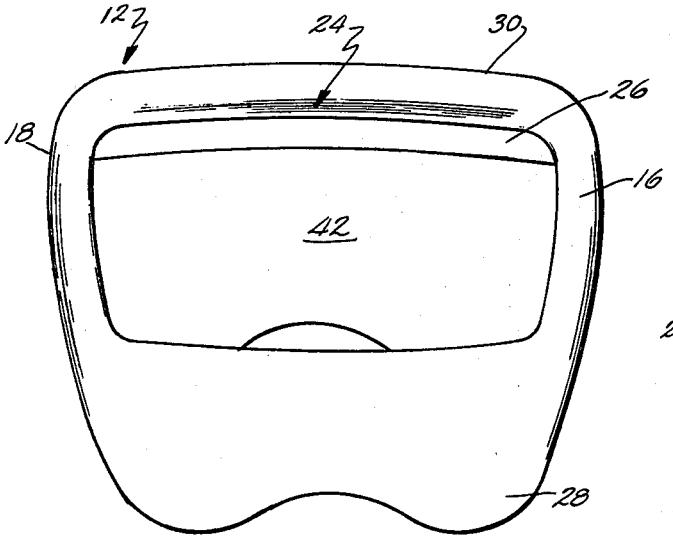
FIG. 3 is a front, elevational view of the device and which shows the indicator means in accordance with the present invention.

A preferred embodiment of a training device or aid in accordance with the present invention is illustrated in FIG. 1 and generally designated 10. Device 10 is a headpiece which is worn by the user and restricts or limits the field of view of the user. As best seen in FIGS. 2 and 3, device 10 includes a peripheral vision limiting means or hood 12 and a support means 14. Hood 12 includes transversely spaced side panels 16, 18. Support means 14 is preferably an adjustable, elongated headband secured to panels 16, 18 by suitable fasteners 20. Band 14 comprises an elongated strap 30 having ends joined by an adjustable snap 22. A sweatband could be attached to band 14 to increase comfort. The band may be adjusted to fit the head of the particular user by overlapping the ends thereof and securing them together by the snap 22. As seen in FIG. 1, when the band is adjusted and positioned on the head of the user, side panels 16, 18 will extend outwardly along the sides of the user's head. It should be understood that other well-known band adjustment means may be employed.

Side panels 16, 18 of hood 12 are joined to a front panel 24. Front panel 24 defines an aperture 26. The user, therefore, looks through aperture 26. Front panel 24 includes a downwardly depending portion 28 configured to limit or restrict downward vision of the user. Hood 12 further includes a top panel 30 which joins side panels 16, 18 and which is also joined to the front panel 24. Top panel 30 limits or restricts the upward vision of the user and also serves as a sun shield. As is clear from FIG. 1, the configuration of the hood 12 requires the user to concentrate in a forward direction. Distractions are eliminated since the field of vision is severely restricted. This restriction of the field of vision requires the user to keep "his eyes on the ball" during play.

In accordance with the invention, provision is made for teaching the player to eliminate the tendency to tilt the head downwardly and out of the preferred horizontal position. An indicating means generally designated 40 positively indicates to the user when the head is tilted. In the preferred embodiment illustrated in FIGS.

Figure 4:
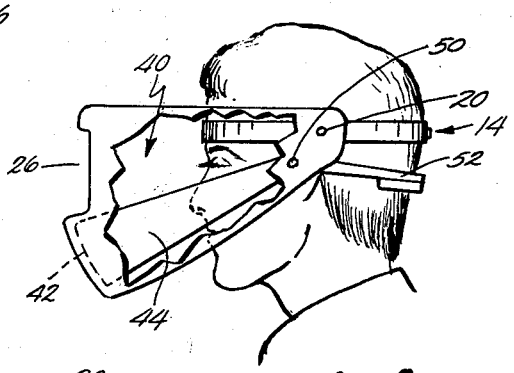
FIG. 4 is a fragmentary, side elevational view of the device.
Figure 5:
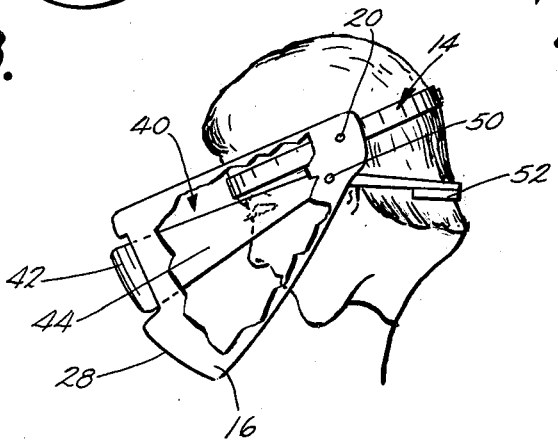
FIG. 5 is a fragmentary, side elevational view of the device showing the manner of operation of the indicator means.

2, 4 and 5, indicator means 40 includes a generally U-shaped member having a base portion 42 and side legs 44, 46. Means 40 is secured to the hood structure 12 in a manner which causes base portion 42 to block and/or enter the field of vision of the user should the head be tilted downwardly. As seen in FIGS. 2 and 4, side legs 44, 46 are pivoted to side panels 16, 18 by suitable pivot means in the form of pins 50. Side leg 44 extends rearwardly from the base portion 42 and includes a counterweight 52. The mass of the counterweight 52 is selected so that means 40 is maintained in equilibrium about pivot pins 50. When top panel 30 of hood 12 is in an essentially horizontal position with respect to the playing surface, base portion 42 of the indicating means 40 is positioned below aperture 26. The user, therefore, has a clear field of vision through the aperture and is forced to maintain his "eyes on the ball." As illustrated in FIGS. 3 and 5, however, should the user tilt his head downwardly from the preferred horizontal plane, hood 12 will pivot about pins 50 and aperture 26 will move in front of base portion 42 of indicator means 40. The indicator means, due to the counterweight 52, will be maintained in its normal "horizontal" position relative to the playing surface. As a result, base portion 42 moves into the field of view of the user and will block or partially limit viewing through aperture 26. Indicator means 40, therefore, provides a positive visual indication to the user that he is not bending his knees to properly position his upper body and head to achieve a more accurate and preferred level swing.

The training aid or device in accordance with the present invention is preferably manufactured from an opaque material, such as a molded plastic. As a result, the device is relatively light in weight and relatively easily and inexpensively manufactured. The primary consideration involves restriction of the peripheral vision of the user and provision for indicating improper movement or tilting of the head.

In view of the foregoing, various modifications will undoubtedly become apparent to those of ordinary skill in the art which would not depart from the inventive concepts disclosed herein. For example, the top panel 30 and front panel extension 28 could be modified or eliminated while still providing structure which would require concentration on the ball. Further, other indicating means than that disclosed could be employed. For example, the indicating means 40 could be modified so as not to fully block the field of vision of the user. Other means which would move into the field of vision or be noticed by the user upon head tilting could be employed. Also, a rotary, viscous dampening device could be incorporated at the pivot points or pins 50 of the indicator means 40 to dampen movement of the indicator means. This would eliminate blocking of vision during normal running or rapid head movements. The force exerted on the indicator means 40, however, should be such that improper downward tilting of the head would cause the aperture 26 to move over and in front of the indicator means. Further, while the indicator means has been illustrated as mounted within the confines of the hood, it could be mounted on the outside without any adverse effect on its function. The above description should be considered only as that of the presently preferred embodiment of the present invention. The true spirit and scope of the present invention should be determined by reference to the appended claims.

The embodiments of the invention in which an exclusive property or privilege is claimed are defined as follows:

1. A training aid primarily adapted for use in training a tennis player to properly orientate the head and to concentrate on the tennis ball, said aid comprising:
   - a hood having a pair of spaced side panels defining an aperture through which the user must view;
   - a band secured to said hood, said band adapted to support the hood on the head of the user and in a position so that the user must look through said aperture, said hood dimensioned to limit the peripheral vision of the user; and
   - indicator means secured to said hood adjacent said aperture for visually indicating when the user moves his head and eyes from a normal horizontal position relative to a playing surface by moving into and at least partially blocking said aperture of said hood.

2. A training aid as defined by claim 1 wherein said hood further includes a front panel having generally vertically oriented lateral side edges, said side panels being joined to said lateral side edges and said front panel defining said aperture.

3. A training aid as defined by claim 2 wherein said hood further includes a top panel joined to said front panel along a top edge thereof and also joined to said side panels.

4. A training aid as defined by claim 3 wherein said indicator means comprises:
   - a generally U-shaped member having a base portion and side leg portions;
   - pivot means engaging said side leg portions for pivotally securing said U-shaped member to said hood in a position wherein said base portion is adjacent said aperture; and
   - counterweight means on at least one of said side leg portions for countering the weight of said base portion so that said U-shaped member is in equilibrium about said pivot means, said U-shaped member staying in said normal horizontal position so as to block said aperture when said hood tilts downwardly from horizontal.

5. A training aid primarily adapted for use in training a tennis player to properly orientate the head and to concentrate on the tennis ball, said aid comprising:
   - a hood having a pair of spaced side panels defining an aperture through which the user must view;
   - a band secured to said hood, said band adapted to support the hood on the head of the user and in a position so that the user must look through said aperture, said hood dimensioned to limit the peripheral vision of the user; and
   - indicator means secured to said hood adjacent said aperture for visually indicating when the user moves his head and eyes from a normal horizontal position relative to a playing surface, and wherein said indicator means comprises:
   - a member pivoted to said hood, said member having a vision blocking portion at one end and a counterweight at an end opposite said one end; and
   - pivot means engaging said member for pivoting said member to said hood so that said member, due to said counterweight, will essentially stay in said normal horizontal position as said hood moves from horizontal due to tilting of the user's head.

6. A device primarily adapted for training a tennis player to bend the knees and maintain the eyes in essentially a horizontal position relative to the playing surface, said device comprising:

a peripheral vision restricting means for defining a limited forward field of view for the player;

support means engaging said vision restricting means for supporting same on the head of the player at the level of the eyes of the user; and head tilt indicating means supported on one of said vision restricting means and said support means and actuable by gravity for indicating to the player when the head is tilted substantially vertically downwardly from said horizontal position by moving into and at least partially blocking said limited field of view defined by said vision restrictring means upon tilting of the device from said horizontal position.

7. A device as defined by claim 6 wherein said vision restricting means further includes means for restricting downward and upward vision of the player.

8. A device as defined by claim 7 wherein said vision restricting means comprises:

a hood having a top panel and transversely spaced side panels joined to said top panel.

9. A device as defined by claim 8 wherein said vision restricting means further includes a front panel joined to said top panel and said side panels, said front panel defining an aperture through which the player looks and a depending lower portion extending downwardly from said aperture to block downward vision of the player.

10. A device as defined by claim 9 wherein said tilt indicating means comprises:

a member; and means for supporting said member with respect to said vision restricting means so that said member moves into the field of view of the player when the player tilts his head downwardly from said horizontal position.

11. A device as defined by claim 9 wherein said indicator means comprises:

a generally U-shaped member having a base portion and side leg portions;

pivot means engaging said side leg portions for pivotally securing said U-shaped member to said hood in a position wherein said base portion is adjacent said aperture; and counterweight means on at least one of said side leg portions for countering the weight of said base portion so that said U-shaped member is in equilibrium about said pivot means, said U-shaped member staying in an essentially fixed position so as to block said aperture when said hood tilts downwardly from horizontal.

12. A device as defined by claim 11 wherein said hood is formed in one piece from an opaque material.

13. A device as defined by claim 6 wherein said tilt indicating means comprising:

a member; and means for supporting said member with respect to said vision restricting means so that said member moves into the field of view of the player when the player tilts his head downwardly from said horizontal position.

14. A device primarily adapted for training a tennis player to bend the knees and maintain the eyes in essentially a horizontal position relative to the playing surface, said device comprising:

a peripheral vision restricting means for defining a limited field of view for the player;

support means engaging said vision restricting means for supporting same on the head of the player at the level of the eyes of the user; and head tilt indicating means supported on one of said vision restricting means and said support means for indicating to the player when the head is tilted downwardly from said horizontal position, said head tilt indicating means providing a visual indication to the player when the head is tilted downwardly, and wherein said tilt indicating means includes:

a member having a vision blocking portion at one end and a counterweight at an end opposite said one end; and pivot means engaging said member for pivoting said member to said hood so that said member, due to said counterweight, will stay in essentially a horizontal position as said hood moves from horizontal due to tilting of the user's head.

* * * * *